US006135847A

United States Patent [19]

Coates

[11] Patent Number: 6,135,847

[45] Date of Patent: Oct. 24, 2000

[54] PUPPETS AND CHARACTER REPRESENTATIONS

[76] Inventor: Andrew Stephen Coates, Clanbaniffe, New Road, Beer, Devon EX12 3HS, United Kingdom

[21] Appl. No.: 09/395,479

[22] Filed: Sep. 14, 1999

[30] Foreign Application Priority Data

Sep. 24, 1998 [GB] United Kingdom ..... 9820716

[51] Int. Cl.[7] ..... A63H 3/14

[52] U.S. Cl. ..... 446/341; 446/339; 446/366; 446/367; 446/337; 446/327; 446/329; 446/319; 446/320

[58] Field of Search ..... 446/319, 320, 446/327, 329, 337, 339, 341, 366, 367

[56] References Cited

U.S. PATENT DOCUMENTS

| | | |
|---|---|---|
| 1,403,515 | 1/1922 | Mathews . |
| 2,184,639 | 12/1939 | Exline . |
| 2,720,053 | 10/1955 | Knott . |
| 3,757,465 | 9/1973 | Barlow . |
| 4,094,092 | 6/1978 | Bunin . |
| 4,276,715 | 7/1981 | Rogers . |
| 4,341,035 | 7/1982 | Jaworski . |
| 4,364,195 | 12/1982 | Kleve . |
| 4,801,286 | 1/1989 | Orenstein et al. . |

FOREIGN PATENT DOCUMENTS

| | | |
|---|---|---|
| 2270676 | 3/1994 | United Kingdom . |

*Primary Examiner*—Jacob K. Ackun
*Assistant Examiner*—Kevin Hughes
*Attorney, Agent, or Firm*—Melvin I. Stoltz

[57] ABSTRACT

A puppet (10) or other character representation includes an inner tube (11), an outer tube (12) and an extra tube (13) located within the inner tube (11). The upper ends of the inner and outer tubes (11 and 12) are connected by a sleeve (23) of simulation hair. A moulding (16) is secured to the outer tube (12) and has the appropriate facial characteristics including an opening (19) corresponding to the mouth of the character. The extra tube (13) has an upper edge which is connected to the part of the moulding (16) which provides the lower jaw of the character.

10 Claims, 5 Drawing Sheets

PUPPETS AND CHARACTER REPRESENTATIONS

FIELD OF THE INVENTION

This invention relates to puppets and character representations and is concerned with the provision of improved forms of puppets and character representations.

British Patent No. 2 270 676 relates to a character representation, e.g. a puppet, in the form of two tubes, namely an inner tube and an outer tube, the outer tube carrying the representation of the character and being formed with one or more openings at a position or positions which corresponds or correspond to a particular facial feature or features of the character, and the inner tube, which is movable within the outer tube, carrying a representation or representations of said facial features such that, by movement of the inner tube within the outer tube, simulated movement of said facial feature or features can be effected.

Such a character representation is hereinafter referred to for convenience as "a character representation as defined".

It is a further object of the present invention to provide an improved form of character representation as defined.

SUMMARY OF THE INVENTION

According to a first aspect of the present invention there is provided a character representation as defined in which the inner tube is connected to the outer tube by simulation hair such that movement of the simulation hair of the character is effected by movement of the inner tube within the outer tube.

According to a second aspect of the present invention there is provided a character representation as defined which includes an extra tube movable relative to the inner and outer tubes, movement of the extra tube relative to the outer tube serving to effect movement of a simulation lower jaw of the character.

The character representation may thus include three tubes, namely an outer tube, an extra tube and an inner tube, with movement of the inner tube relative to the outer tube serving to effect movement of the simulation hair and of simulation eyes of the character, and movement of the extra tube relative to the outer tube serving to effect movement of the simulation lower jaw of the character.

Alternatively, of course, a character representation according to the first aspect of the present invention may include just two tubes, with movement of the inner tube relative to the outer tube serving to effect movement of the simulation hair and eyes of the character. The arrangement may, of course, also be such that movement of the inner tube relative to the outer tube serves also to effect movement of the simulation lower jaw of the character.

The extra tube may be located between the inner and outer tubes. Alternatively, it may be located within the inner tube, which will then be provided with a cut-out in the area corresponding to the simulation mouth of the character to permit connection of the extra tube to the simulation lower jaw of the character.

The extra tube may be relatively short in length, as compared to the inner and outer tubes, and may be connected to a rod which extends coaxially of the inner and outer tubes and terminates in a ring within which a finger or thumb can be inserted for effecting manipulation of the extra tube. The inner tube may be formed with an opening to provide access to said ring.

The character representation may also be provided with arms pivotally connected either to the outer tube or to clothes fitted on the outer tube. The arms preferably terminate in spigots which have push-fit engagements in sockets formed in hands which can be secured to a table or other support. The arms are preferably articulated so that upward and downward movement of the character representation relative to the table or other support will produce simulated movement of the arms of the character.

DESCRIPTION OF THE PREFERRED EMBODIMENTS

Figure 1:
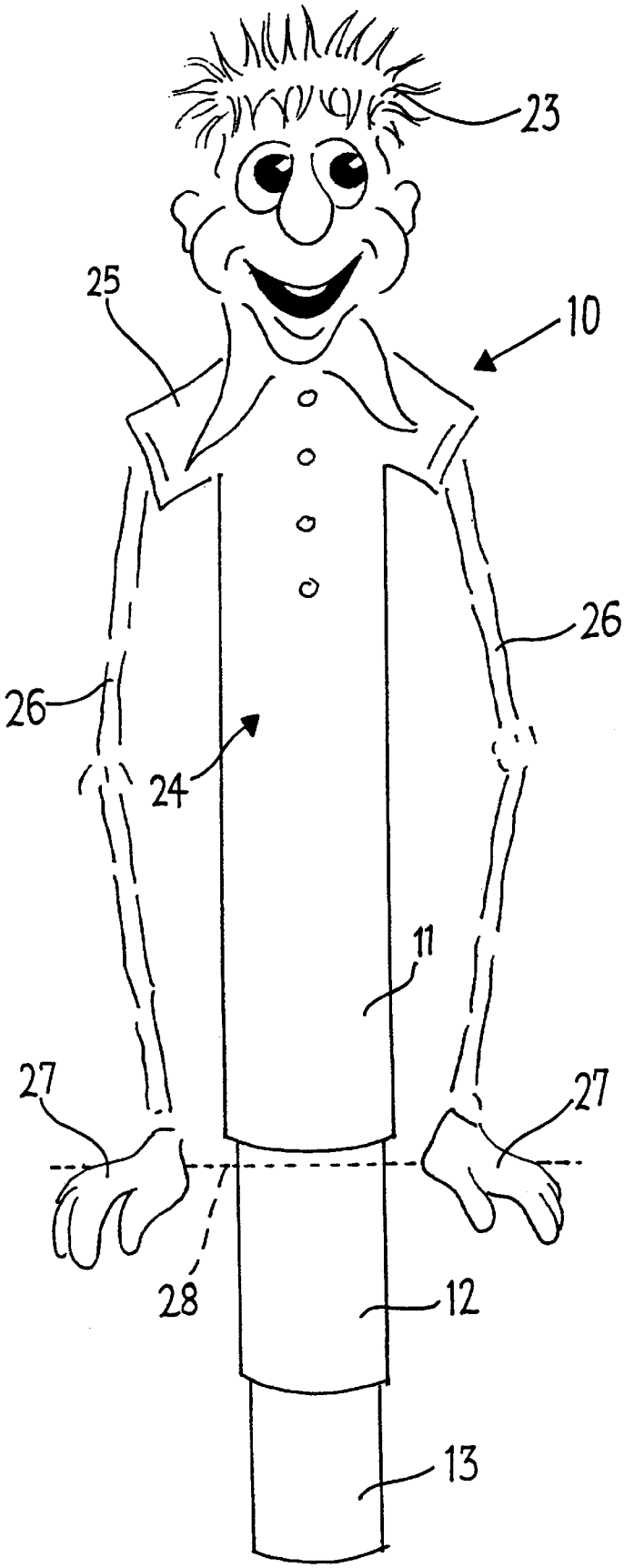
FIG. 1 shows a character representation in the form of a puppet for use in children's entertainment shows and the like, FIG. 2 shows the method of attachment of the simulation hair of the puppet.
Figure 2:
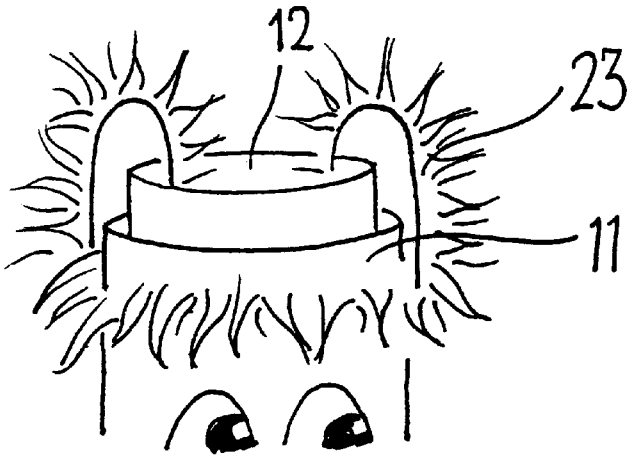

The puppet 10 shown in the drawings is formed from three elongated cylindrical or tubular members, namely an outer member 11, an inner member 12 and an extra member 13, which are slidable relative to one another. The outer member 11 is formed with two cut-outs, one 14 in the area corresponding to the eyes of the puppet 10 and the other 15 in the area corresponding to the mouth of the puppet. A moulding 16 formed of a readily deformable rubber or synthetic plastics material is produced having the required facial characteristics and is secured to the outer member 11 in the position indicated by broken lines in FIG. 3. The moulding 16 has openings 17 and 18 at positions corresponding to the eyes of the puppet 10 and an opening 19 at a position corresponding to the mouth of the puppet 10.

The inner tubular member 12 is marked with the eyes 20 of the puppet 10 and is formed with an opening 21 at a position corresponding to the mouth of the puppet 10. The extra tubular member 13 has an upper edge formed with a recess 22 and said upper edge is connected, through the opening 21, to the part of the moulding 16 which provides the lower jaw of the puppet 10. When, therefore, the extra tubular member 13 is moved upwardly and downwardly relative to the outer member 11, this will produce corresponding movement of the lower jaw of the puppet 10.

The eyes 20 of the puppet 10 may be so formed that they project from the adjacent portion of the inner tubular member 12 to such an extent that, when the inner tubular member 12 is moved relative to the outer tubular member 11, the eyes 20 will contact the edges of the opening 14 formed in the outer tubular member 11, providing an indication to the person moving the inner tubular member 12 that the eyes 20 are at the limit of their normal range of movement. This facilitates "realistic" movement of the eyes 20 of the puppet 10.

The upper end of the inner tubular member 12 is connected to the upper end of the outer tubular member 11 by a sleeve 23 formed of simulation hair. When, therefore, the inner tubular member 12 is moved relative to the outer tubular member 11, either up and down or rotationally, not only will the eyes 20 of the puppet 10 be seen to move but the hair of the puppet 10 will move thereby increasing the visual impact which is obtained and improving the appeal of the puppet 10, particularly to young children. The puppet 10 is this ideally suited for use on entertainment programmes on the television.

The simulation body of the puppet 10 may be of elongated form (as shown in FIG. 1) and clothing 24 will be attached to the outer member 11. As shown, the clothing 24 includes sleeves 25 from which arms 26 project. The arms 26 are articulated and terminate in spigots which are push-fitted in sockets formed in hands 27 secured to a table or like support, the edge of which is indicated by the broken line 28 in FIG. 1. The arms 26 are pivotally connected to either the clothing 24 or the outer tubular member 11.

When, therefore, the puppet 10 is being used on a TV show, the person operating the puppet 10 can be concealed from view by the table or like support. The operator can cause bending of the arms 26 of the puppet 10 by moving the body of the puppet 10 up and down relative to the table or like support. The operator can also effect movement of the lower jaw, eyes and hair of the puppet 10 by appropriate movements of the extra tubular member 13 and the inner tubular member 12 relative to the outer tubular member 11.

In the particular embodiment shown in the drawings, the extra tubular member 13 is disposed within the inner tubular member 12. The extra tubular member 13 could, however, alternatively be located intermediate the inner and outer tubular members 12 and 11.

Figure 7:
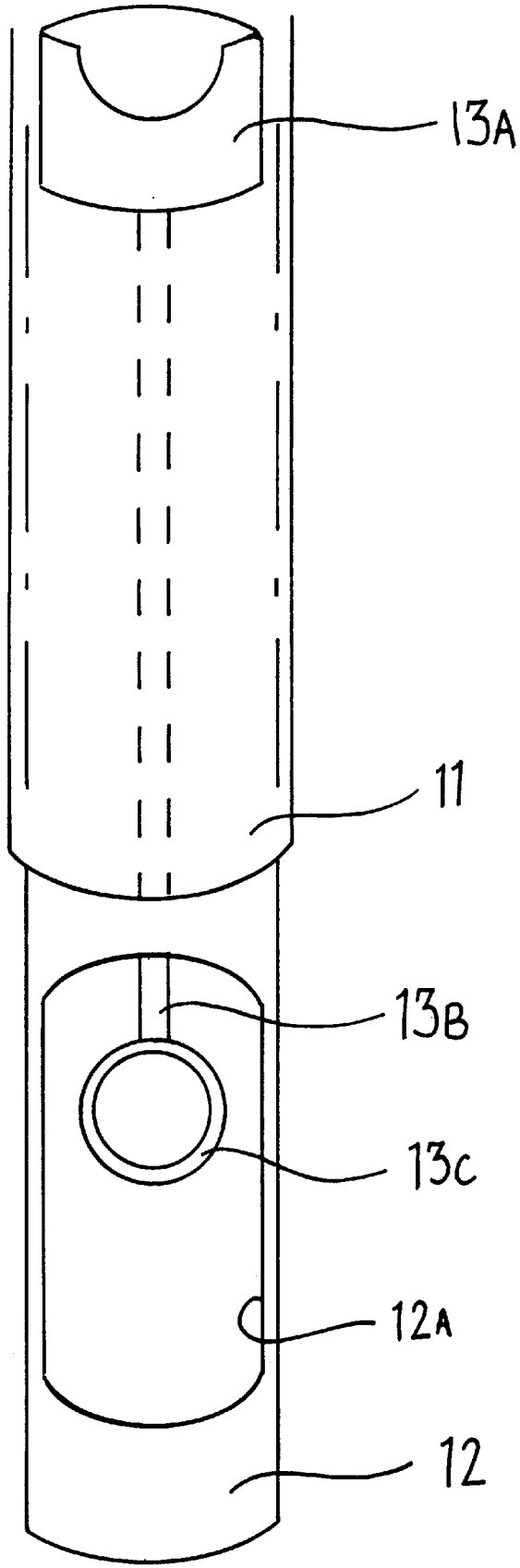
FIG. 7 illustrates a modified arrangement in which the extra tubular member is of an alternative design.

In a modification to the arrangement shown in FIGS. 1 to 6, the extra tubular member 13 comprises a tube 13A which is relatively short in length as compared to the inner tubular member 12 and the outer tubular member 11 (see FIG. 7). The tube 13A is connected to a rod 13B which is coaxial with the inner and outer tubular members 12 and 11 and terminates at its lower end in a ring 13C which is of such size that the person operating the puppet 10 can insert his or her thumb in the ring 13C. As shown in FIG. 7, the inner tubular member 12 may be formed with an opening 12A to provide access to the ring 13C.

Figure 3:
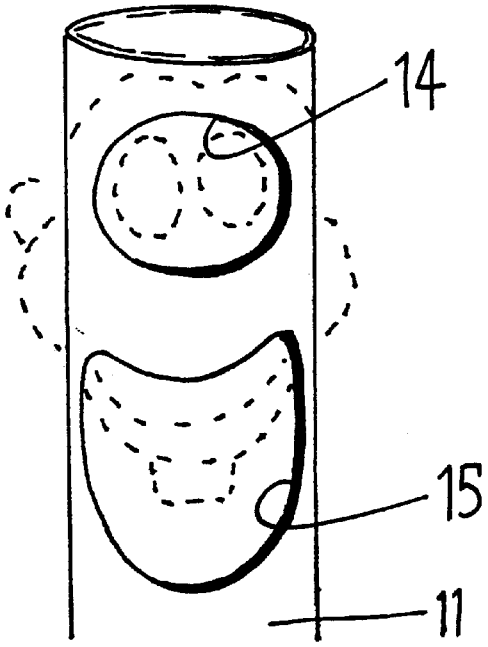
FIG. 3 shows part of the outer tubular member of the puppet.
Figure 4:
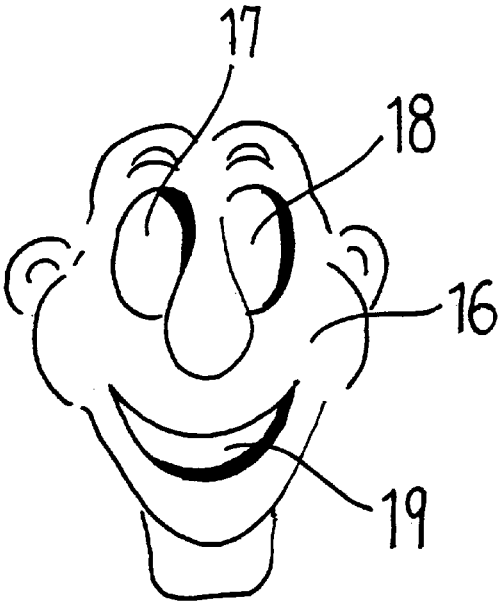
FIG. 4 shows a moulding which is attached to the outer tubular member to provide the facial features of the puppet.
Figure 5:
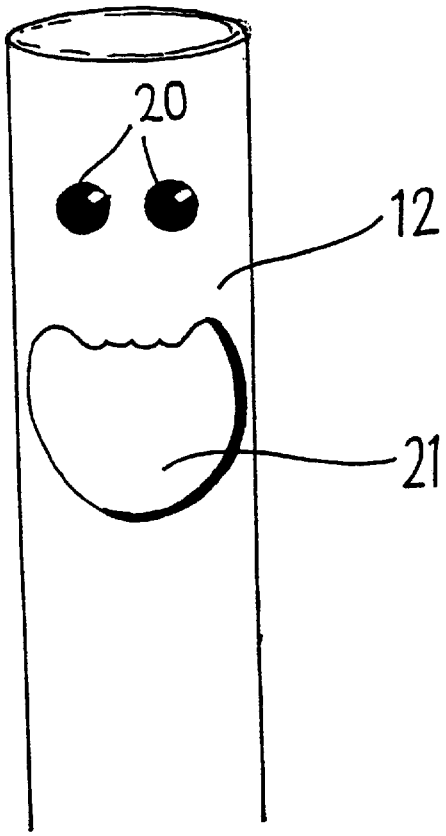
FIG. 5 shows part of an inner tubular member of the puppet.
Figure 6:
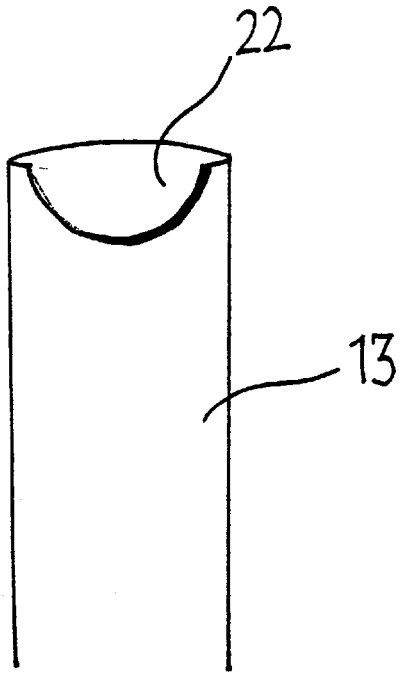
FIG. 6 shows part of an extra tubular member of the puppet.
Figure 8:
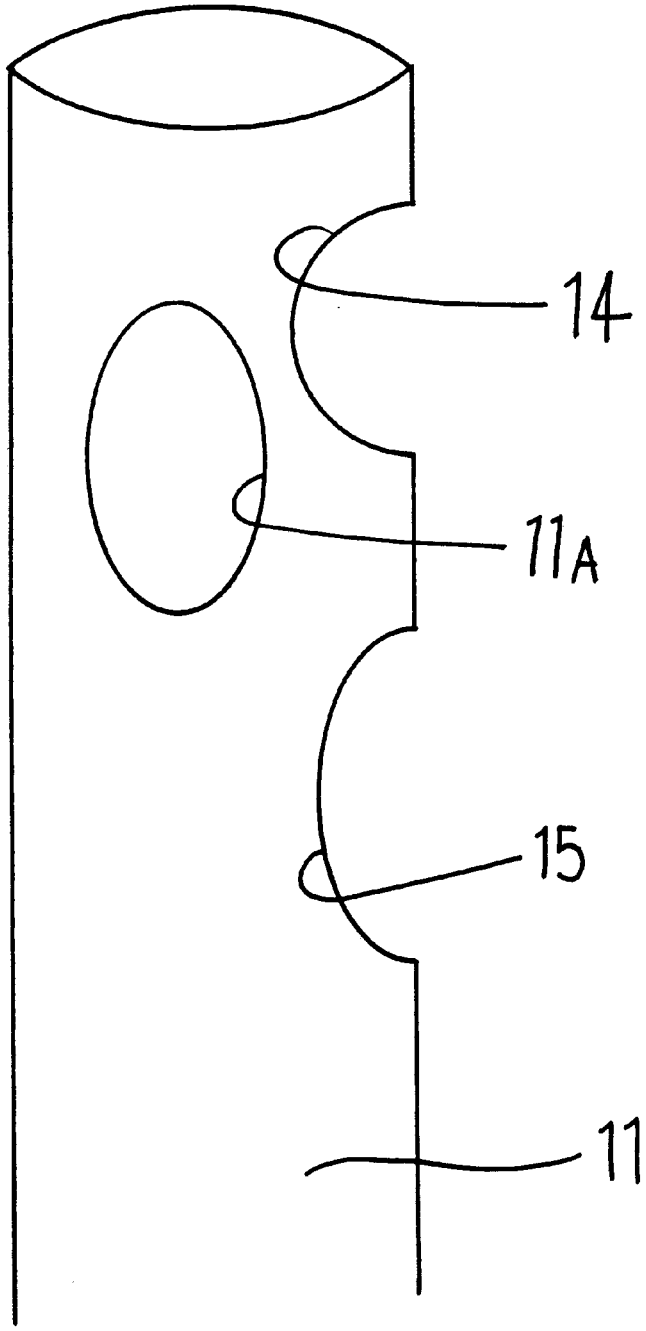
FIG. 8 shows a modified form of outer tubular member as compared to that shown in FIG. 3.

In the arrangement shown in FIG. 3, the outer tubular member 11 is formed with two cut-outs 14 and 15, i.e. one, 14, at a position corresponding to the eyes of the character at the other, 15, at a position corresponding to the mouth of the character. In the alternative arrangement shown in FIG. 8, additional cut-outs 11A are provided at positions corresponding to the ears of the character and the inner tubular member 12 is provided with formations (not shown) which extend through the cut-outs 11A and are connected to those parts of the moulding 16 which simulate the ears of the character.

Thus, when the inner tubular member 12 is moved relative to the outer tubular member 11, not only will the eyes 20 and the hair of the character be moved under the control of the operator, but the simulation ears of the character will also be caused to move, thereby extending the range of changes of expression which can be achieved.

What is claimed is:

1. A character representation comprising an inner tube and an outer tube, the outer tube carrying a representation of a character and being formed with at least one opening at a position which corresponds to a particular facial feature of the character, the inner tube being movable within the outer tube and carrying a representation of said facial feature such that, by movement of the inner tube relative to the outer tube, simulated movement of said facial feature can be effected, and simulation hair connecting the inner tube to the outer tube such that movement of the simulation hair of the character is effected by movement of the inner tube relative to the outer tube.

2. The character representation as claimed in claim 1, which includes a simulation lower jaw and an extra tube movable relative to the inner and outer tubes, movement of the extra tube relative to the outer tube serving to effect movement of the simulation lower jaw of the character.

3. The character representation as claimed in claim 2, in which the extra tube is located within the inner tube and is relatively short in length, as compared to the inner and outer tubes, the extra tube being connected to a rod which extends coaxially of the inner and outer tubes and terminates in a ring.

4. The character representation as claimed in claim 1, which includes simulation eyes and in which movement of the inner tube relative to the outer tube serves to effect movement of the simulation eyes of the character.

5. The character representation as claimed in claim 3, which has a simulation mouth including the simulation lower jaw and in which the inner tube is provided with a cut-out in the area corresponding to the simulation mouth of the character to permit connection of the extra tube to the simulation lower jaw of the character.

6. A character representation comprising an inner tube and an outer tube, the outer tube carrying a representation of a character having a simulation lower jaw and being formed with at least one opening at a position which corresponds to a particular facial feature of the character, the inner tube movable within the outer tube and carrying a representation of said facial feature such that, by movement of the inner tube relative to the outer tube, simulated movement of said facial feature can be effected, and an extra tube movable relative to the inner and outer tubes, movement of the extra tube relative to the outer tube serving to effect movement of the simulation lower jaw of the character.

7. The character representation as claimed in claim 6, which has simulation eyes and simulation hair and in which movement of the inner tube relative to the outer tube serves to effect movement of the simulation eyes and simulation hair of the character.

8. The character representation as claimed in claim 6, which has a simulation mouth including the simulation lower jaw and in which the extra tube is located within the inner tube and the inner tube is provided with a cut-out in the area corresponding to the simulation mouth of the character to permit connection of the extra tube to the simulation lower jaw of the character.

9. The character representation as claimed in claim 1, which is provided with arms pivotally connected to one of the outer tube and clothes fitted on the outer tube.

10. The character representation as claimed in claim 9, in which the arms terminate in spigots which have push-fit engagement in sockets formed in hands which can be secured to a support.

* * * * *